US009541044B2

(12) United States Patent
Host et al.

(10) Patent No.: US 9,541,044 B2
(45) Date of Patent: Jan. 10, 2017

(54) INTAKE MANIFOLD SECONDARY GAS DISTRIBUTION VIA STRUCTURAL POSTS

(71) Applicant: FORD GLOBAL TECHNOLOGIES, LLC, Dearborn, MI (US)

(72) Inventors: Ray Host, Mount Clemens, MI (US); Milind B. Kulkarni, Canton, MI (US); Calvin C. Tran, Canton, MI (US); Joshua D. Simon, Sylvania, OH (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 227 days.

(21) Appl. No.: 14/606,090

(22) Filed: Jan. 27, 2015

(65) Prior Publication Data

US 2016/0215738 A1 Jul. 28, 2016

(51) Int. Cl.
*F02M 35/10* (2006.01)
*F02M 35/104* (2006.01)

(52) U.S. Cl.
CPC ..... *F02M 35/1036* (2013.01); *F02M 26/17* (2016.02); *F02M 35/104* (2013.01); *F02M 35/10052* (2013.01); *F02M 35/10222* (2013.01); *F02M 35/10321* (2013.01); *F02M 35/10347* (2013.01)

(58) Field of Classification Search
CPC ..... F02M 35/10052; F02M 35/10347; F02M 35/1036; F02M 35/108; F02M 35/104; F02M 21/0215; F02M 21/04; F02M 21/042; F02M 21/02; F02M 26/13; F02M 37/0011
USPC ..... 123/184.21, 184.24, 184.25, 184.26, 123/184.27, 184.34, 184.36, 184.47, 123/568.11, 568.17, 470
See application file for complete search history.

(56) References Cited

U.S. PATENT DOCUMENTS

| | | | | |
|---|---|---|---|---|
| 6,155,223 | A | 12/2000 | Miazgowicz | |
| 6,267,093 | B1 | 7/2001 | Lohr | |
| 6,607,172 | B1 * | 8/2003 | Green | F02M 26/48 248/309.1 |
| 6,691,686 | B2 | 2/2004 | Klas et al. | |
| 6,935,321 | B1 * | 8/2005 | Sullivan | F02M 35/10222 123/568.17 |
| 8,459,226 | B2 | 6/2013 | Moetakef et al. | |

(Continued)

FOREIGN PATENT DOCUMENTS

| | | |
|---|---|---|
| CN | 101832201 | 9/2010 |
| CN | 101994604 | 3/2011 |

(Continued)

*Primary Examiner* — Marguerite McMahon
*Assistant Examiner* — Tea Holbrook
(74) *Attorney, Agent, or Firm* — Gregory P. Brown; MacMillan, Sobanski & Todd, LLC

(57) ABSTRACT

An intake manifold for an internal combustion engine comprises upper and lower shell members with outer flanges. The shell members define a manifold cavity having a plenum and a plurality of runners. The upper shell includes an upper post formed as an indentation into the plenum with a tunnel wall and a terminus wall. The lower shell includes a lower post formed as an indentation into the plenum with a tunnel wall and a terminus wall. The terminus walls are attached to provide a brace across the plenum. One of the posts includes an orifice penetrating the tunnel wall. A sealed coupler extends from the one post and is adapted to receive a secondary gas for mixing within the plenum. Thus, secondary gases can be introduced without additional structures that could impede gas flow and could increase manufacturing cost.

7 Claims, 5 Drawing Sheets

(56) References Cited

U.S. PATENT DOCUMENTS

| | | | | |
|---|---|---|---|---|
| 8,567,365 | B2 | 10/2013 | Lohr | |
| 8,607,756 | B1 | 12/2013 | Kulkarni et al. | |
| 8,651,081 | B2 | 2/2014 | Newman et al. | |
| 2004/0040549 | A1* | 3/2004 | Murphy | F02M 35/10222 123/568.17 |
| 2004/0144373 | A1* | 7/2004 | Spix | F02M 35/10144 123/572 |
| 2010/0031913 | A1* | 2/2010 | Rolland | F02M 35/10039 123/184.21 |
| 2011/0253080 | A1* | 10/2011 | Newman | F02M 35/10321 123/54.4 |
| 2012/0017864 | A1* | 1/2012 | Moetakef | B23K 20/129 123/184.61 |
| 2016/0061166 | A1* | 3/2016 | Tanaka | F02M 35/10222 123/184.22 |
| 2016/0201620 | A1* | 7/2016 | Yano | F02M 35/10321 123/184.27 |

FOREIGN PATENT DOCUMENTS

| | | | |
|---|---|---|---|
| CN | 102536547 | A | 7/2012 |
| EP | 2098716 | A2 | 9/2009 |
| JP | 10252577 | | 9/1998 |

* cited by examiner

INTAKE MANIFOLD SECONDARY GAS DISTRIBUTION VIA STRUCTURAL POSTS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to intake manifolds for combustion engines, and, more specifically, to apparatus for introducing secondary gases into the main fuel/air mixture passing through the intake manifold.

Intake manifolds for internal combustion engine are commonly formed out of a polymeric material. In an effort to reduce noise radiating from the surface of the intake manifold due to resonant frequencies set up at particular engine speeds, it is known to provide internal and external bracing on the surface of the manifold and to provide internal posts formed out of the parent material. The internal posts traverse through the plenum cavity within the manifold, and are typical formed as indentations in upper and lower shell members. Each indentation penetrates the plenum cavity with a tunnel wall and a terminus wall. The terminus walls of the upper and lower shell members are friction welded together at the same time that outer flanges of the shell members are welded together.

Any internal structure, such as the posts, may reduce the flow area within the intake manifold which can limit the peak power of the engine. It may be possible to increase the size of the intake manifold to overcome the drop in flow area due to internal structures, but with a corresponding increase in overall size of the manifold which increases cost and weight and complicates packaging.

One additional internal structure may include features for introducing secondary gases into the intake manifold for distribution to the engine cylinders. Secondary gas sources may include an exhaust gas recirculation (EGR) system, a positive crankcase ventilation (PCV) system, and a fuel tank vapor recovery system. Ports (including tubes and injection channels) may obstruct or disrupt air flow within the manifold, especially when several such ports are deployed. Furthermore, limited space availability can result in attempting to locate ports in cramped spots which makes attachment to external devices difficult or results in interference with other components attached to the manifold.

SUMMARY OF THE INVENTION

The invention integrates a secondary gas port into a bracing post which may optimize the distribution of secondary gases while minimizing obstructions and decreasing manufacturing cost.

In one aspect of the invention, an intake manifold comprises upper and lower shell members. The upper shell member has an outer flange. The lower shell member has an outer flange joined to the outer flange of the upper shell member to define a manifold cavity having a plenum and a plurality of runners. The upper shell includes an upper post formed as an indentation into the plenum with a tunnel wall and a terminus wall. The lower shell includes a lower post formed as an indentation into the plenum with a tunnel wall and a terminus wall. The terminus walls are attached to provide a brace across the plenum. One of the posts includes an orifice penetrating the tunnel wall. A sealed coupler extends from the one post and is adapted to receive a secondary gas for mixing within the plenum.

DETAILED DESCRIPTION OF PREFERRED EMBODIMENTS

Figure 1:
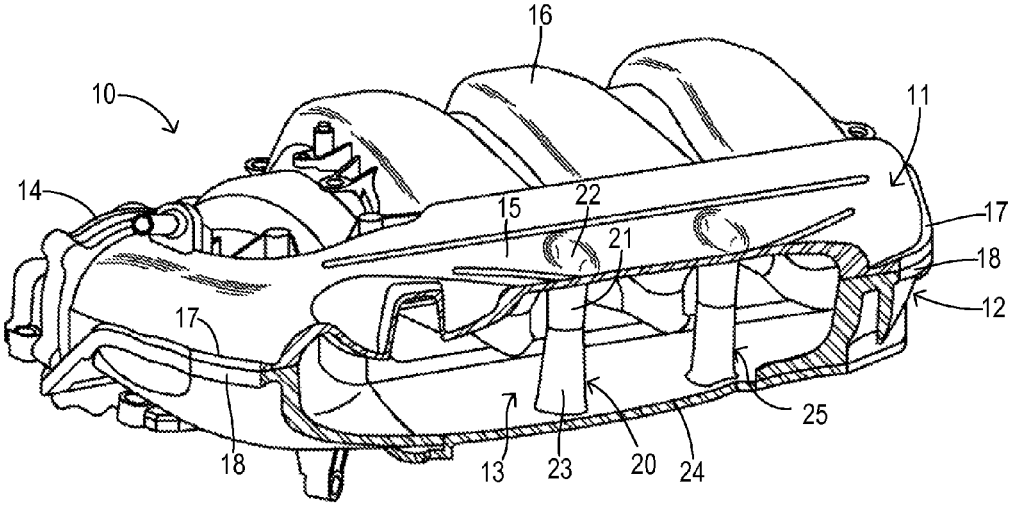
Fig. 1 (Prior Art)
FIG. 1 is a cutaway view of an intake manifold of the prior art.

Referring to FIG. 1, an intake manifold 10 has an upper shell member 11 and a lower shell member 12 which define a chamber 13. Shell members 11 and 12 further define an inlet 14 (which receives a fuel/air mixture via a throttle body), a plenum section 15, and a runner section 16 with a plurality of runners for fluidically coupling the plenum with respective engine cylinders (not shown). Upper shell member 11 and lower shell member 12 are coupled at first outer flange 17 and second outer flange 18. Two posts 20 and 25 extend through the plenum section of chamber 13 between shell members 11 and 12 to provide bracing that reduces vibrations of manifold 10.

Post 20 has an upper post section 21 formed as an indentation 22 into an outer surface of plenum section 15. Post 20 has a lower post section 23 formed as an indentation into an outer surface 24 of lower shell member 12. Flanges 17 and 18 are coupled together in a friction welding process, during which adjacent ends of post sections 21 and 23 are friction welded, thereby creating a single substantially rigid post 20 extending between upper shell member 11 and lower shell member 12. Additional posts such as a post 25 can be assembled in the same manner. Secondary gas ports can be integrated in more than one of the posts, but one such port will normally provide enough gas capacity. Multiple ports may be useful when there is a desire to inject secondary gas at various different locations in relation to the runners.

Figure 2:
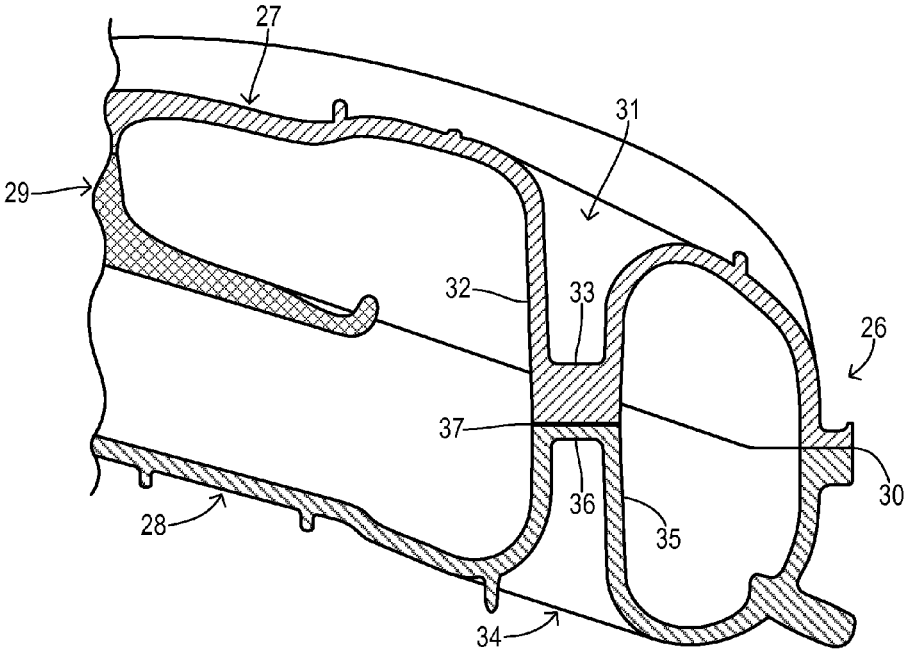
Fig. 2 (Prior Art)
FIG. 2 is a cross-sectional view of another prior art intake manifold.

FIG. 2 shows another prior art intake manifold 26 having an upper shell member 27, a lower shell member 28, and an intermediate shell member 29. Various attachment points such as outer flanges 30 may be friction welded to form an assembly of shell members 27-29 as known in the art. Upper shell member 27 has an upper post 31 formed as an indentation with a tunnel wall 32 and a terminus wall 33, wherein tunnel wall 32 is generally cylindrical. Lower shell member 28 has a lower post 34 formed is an indentation with a tunnel wall 35 and a terminus wall 36. Terminus walls 33 and 36 are friction welded along their abutting ends at 37.

Figure 3:
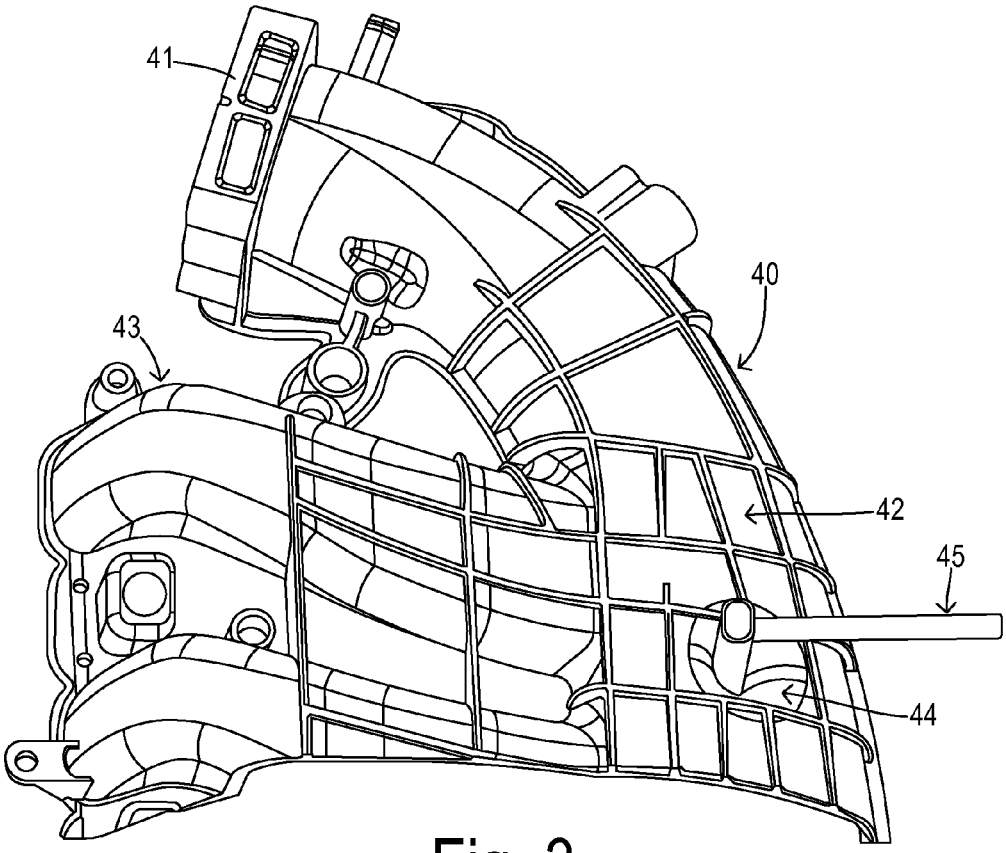
FIG. 3 is a top perspective view of a sectioned upper shell of the invention with a secondary gas port incorporated within a structural post.

An upper or lower post in a shell member provides an advantageous site for locating a secondary gas port, especially a post which is located toward an upstream end of a plenum section near the main inlet of the intake manifold. As shown in FIG. 3, an upper shell member 40 has a manifold inlet 41 leading to a plenum section 42 which feeds a plurality of runners 43. An upper post 44 includes an indentation receiving a sealed coupler 45 mounted on shell member 40 adapted to connect with a source of secondary gas (e.g., an EGR line or a PCV line) and convey it into plenum section 42 via an orifice formed in post 44.

Figure 4:
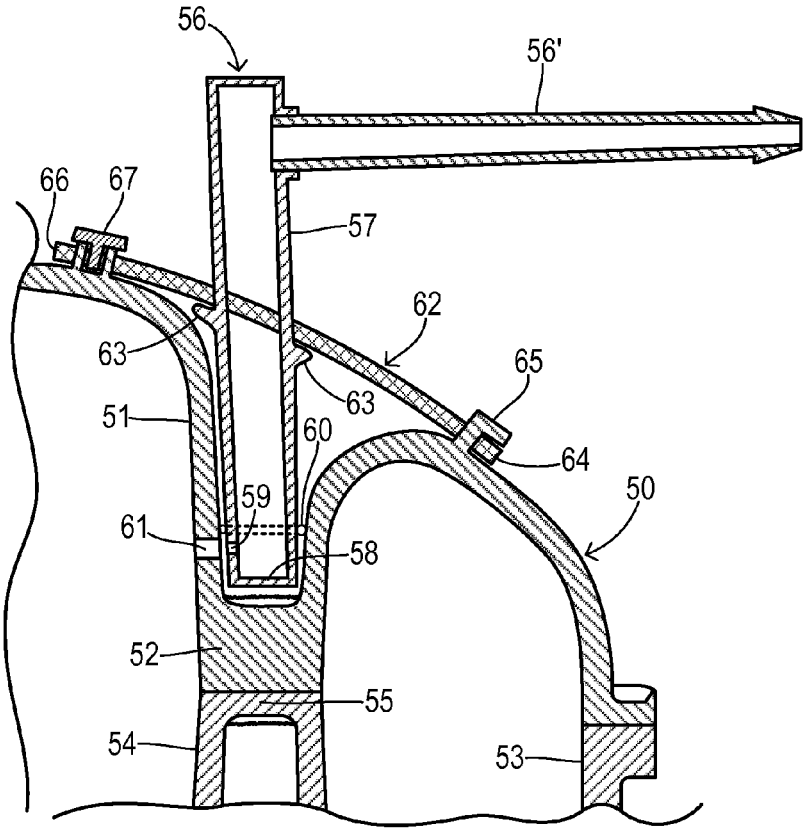
FIG. 4 is a side, cross section of a secondary gas port of another embodiment of the invention.

A secondary gas port is shown in greater detail in FIG. 4 wherein an upper shell member 50 includes an upper post formed with a tunnel wall 51 and a terminus wall 52. Wall 52 is joined in the conventional manner with a lower shell member 53 at a terminus wall 55 of a lower post 54. Sealed coupler 56 is comprised of a hollow body and may include a side entry tube 56' for receiving a secondary gas line or hose (not shown). A cylindrical hollow body 57 extends into tunnel wall 51 and has an end 58. An O-ring seal 60 is compressed between tunnel wall 51 and an outer surface of hollow body 57 at a position spaced away from terminus wall 52. An aperture 59 is located in body 57 between end 58 and O-ring seal 60. Aperture 59 is aligned with an orifice 61 in tunnel wall 51 to convey the secondary gases through sealed coupler 56 and into the plenum chamber for mixing with a main fuel/air mixture that is distributed to the cylinders by the runners.

In order to compress seal 60 and maintain sealed coupler 56 in its desired inserted position within tunnel wall 51, a bracket 62 may be employed. A flange 63 extending from body 57 bears against bracket 62. Bracket 62 has a first end 64 captured over a post 65 on upper shell member 50 and has a second end 66 fastened to ii) upper shell member 50 by a fastener (e.g., screw) 67. Many other attachment methods such as bonding or other types of fastening will occur to those skilled in the art.

Figure 5:
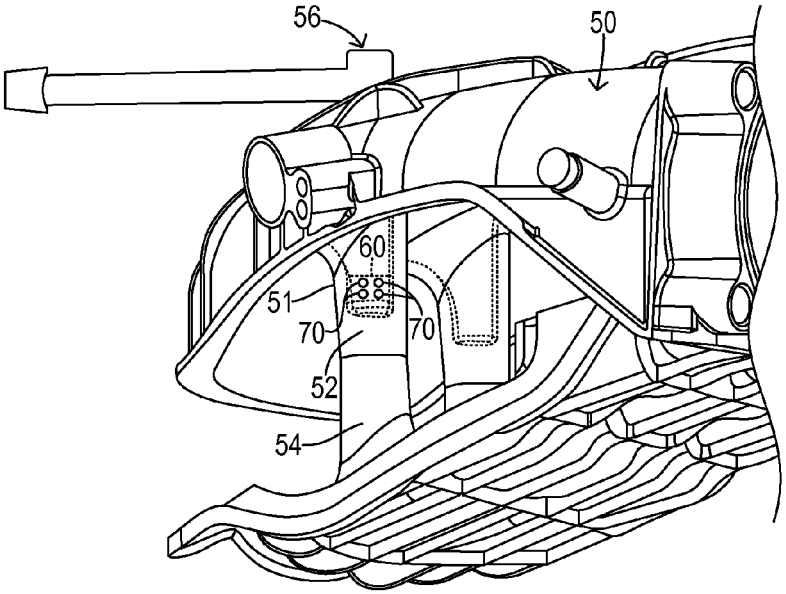
FIG. 5 is a bottom, perspective view showing another embodiment of the invention.

FIG. 5 shows a modified embodiment wherein tunnel wall 51 of upper post has a plurality of orifices 70 to distribute the secondary gas within the plenum chamber. The number, size, and position of orifices 70 can be adjusted according to a desired flow volume and flow direction.

Figure 6:
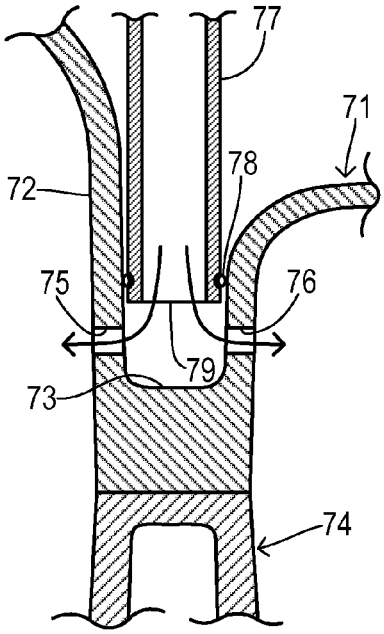
FIG. 6 is a vertical cross section showing secondary gas passages for another embodiment of the invention.

FIG. 6 shows another embodiment wherein an upper post is formed at an indentation 71 with a tunnel wall 72 and terminus wall 73 for joining with a lower post 74. Tunnel wall 72 has oppositely directed orifices 75 and 76 receiving secondary gas via a delivery tube 77 of a sealed coupler having an open end 79. An O-ring seal 78 prevents leakage of secondary gas around or through indentation 71.

Figure 7:
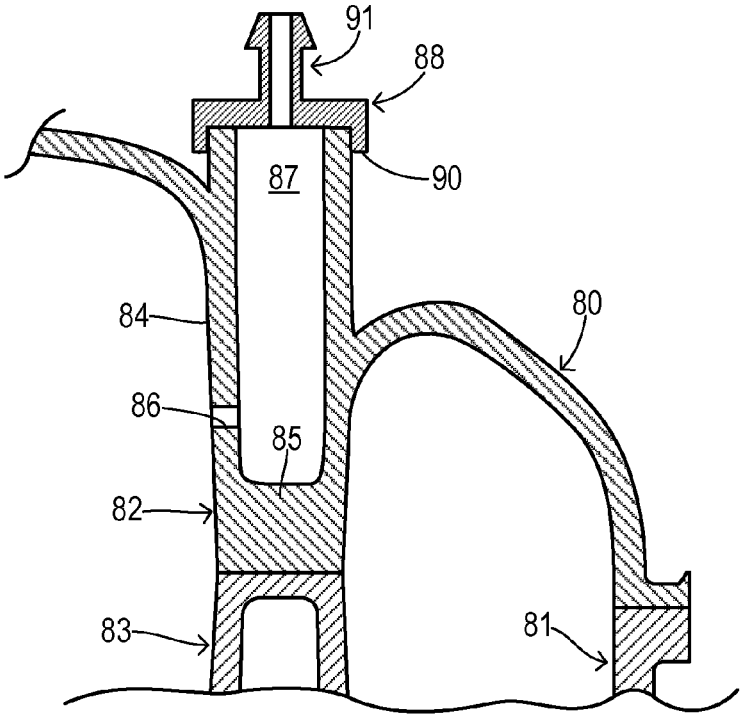
FIG. 7 is a vertical cross section showing a secondary gas port according to yet another embodiment of the invention.

FIG. 7 shows yet another embodiment wherein upper and lower shell members 80 and 81 have upper and lower post sections 82 and 83. Upper post section 82 has a tunnel wall 84 and a terminus wall 85. Tunnel 84 includes an orifice 86 and has an upward extension 87 to provide an integrated upper cylindrical tube to which a cap 88 is mounted. Cap 88 has a cylindrical flange 90 bonded to tubular extension 87 in order to provide a gas-tight seal. A nipple 91 on cap 88 provides a hose connection in order to convey secondary gases through upper post 82 and through orifice 86 into the plenum chamber.

Figure 8:
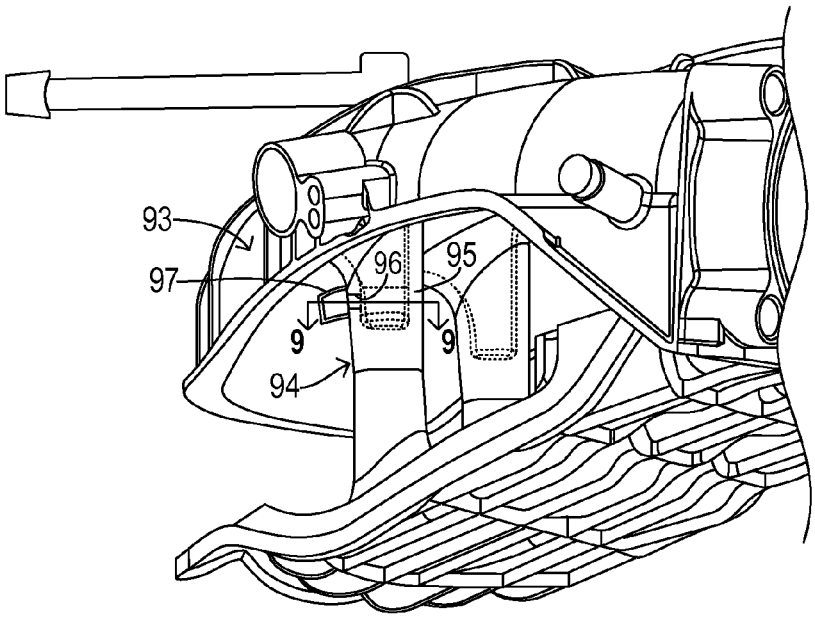
FIG. 8 is a bottom, perspective view showing another embodiment of the invention including a deflector.
Figure 9:
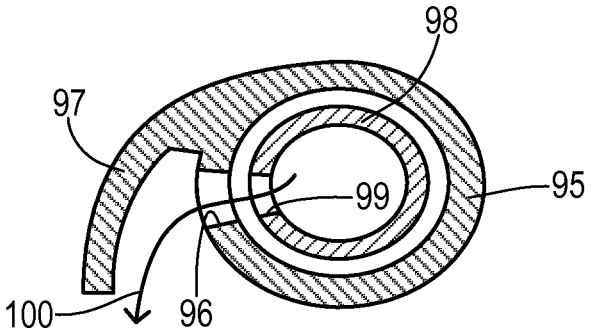
FIG. 9 is a horizontal cross section through the post and deflector along line 9-9 of FIG. 8.

FIG. 8 shows a further modification wherein an upper shell member 93 has an upper post section 94. A tunnel wall 95 includes an aperture 96 and a secondary gas flow deflector 97. The purpose of flow deflector 97 is to orient an outlet flow of secondary gas in order to achieve a desired mixing of the secondary gases with the main fuel/air mixture and to direct a secondary flow toward a desired region of the plenum or to a particular runner. As shown in FIG. 9, deflector 97 may extend from tunnel wall 95 as a curved wing over orifice 96. A sealed coupling tube 98 is disposed within tunnel wall 95 with an aperture 99 aligned with orifice 96 in order to deliver a secondary gas flow 100.

By integrating a secondary gas port into a structural post of the intake ii) manifold as disclosed above, the present invention achieves improved flow as a result of lowering the internal obstructions to flow. The invention can be manufactured at low cost using well established processes. In particular, a polymeric upper shell member can be molded with known materials having an outer flange and an upper post section formed as an indentation with a tunnel wall and a terminus wall. A polymeric lower shell member is also molded having an outer flange and a lower post section formed as an indentation with a tunnel wall and a terminus wall. The upper and lower shell members can be friction welded at the outer flanges and at the terminus walls to define a plenum with the joined post sections providing a brace across the plenum reducing vibrations. The tunnel wall of one of the shell members includes an orifice (e.g., as a result of the original molded shape or formed by a secondary operation such as drilling). A sealed coupler is mounted to the shell member so that it extends from the post section of the one shell member adapted to convey a secondary gas through the orifice for mixing within the plenum.

What is claimed is:

1. An intake manifold comprising:

an upper shell member with an outer flange;

a lower shell member with an outer flange joined to the outer flange of the upper shell member to define a manifold cavity having a plenum and a plurality of runners, wherein the upper shell includes an upper post formed as an indentation into the plenum with a tunnel wall and a terminus wall, wherein the lower shell includes a lower post formed as an indentation into the plenum with a tunnel wall and a terminus wall, wherein the terminus walls are attached to provide a brace across the plenum, and wherein one of the posts includes an orifice penetrating the tunnel wall; and a sealed coupler extending from the one post and adapted to receive a secondary gas for mixing within the plenum.

2. The manifold of claim 1 wherein the coupler is comprised of a separate unit sealed to the tunnel wall by an O-ring, wherein the orifice is disposed intermediate of the O-ring and the terminus wall.

3. The manifold of claim 2 further comprising a bracket mounting the coupler onto the shell member and compressing the O-ring.

4. The manifold of claim 1 wherein the upper and lower shell members are comprised of molded polymeric material, and wherein the outer flanges and the terminus walls are joined by friction welding.

5. The manifold of claim 1 wherein the one post is the upper post.

6. The manifold of claim 1 further comprising a flow guide on a plenum side of the tunnel wall of the one post to deflect secondary gas passing through the orifice into the plenum.

7. A method of manufacturing an intake manifold for an internal combustion engine, comprising the steps of:

molding a polymeric upper shell member having an outer flange and an upper post section formed as an indentation with a tunnel wall and a terminus wall;

molding a polymeric lower shell member having an outer flange and a lower post section formed as an indentation with a tunnel wall and a terminus wall;

friction welding the upper and lower shell members at the outer flanges and at the terminus walls to define a plenum with the joined post sections providing a brace across the plenum reducing vibrations, wherein the tunnel wall of one of the shell members includes an orifice; and mounting a sealed coupler extending from the post section of the one shell member adapted to convey a secondary gas through the orifice for mixing within the plenum.

* * * * *